US006209197B1

(12) United States Patent
Mori et al.

(10) Patent No.: US 6,209,197 B1
(45) Date of Patent: Apr. 3, 2001

(54) METHOD OF MANUFACTURING TAPPET IN AN INTERNAL COMBUSTION ENGINE

(75) Inventors: Akiyoshi Mori, Yokohama; Hiroaki Asanuma, Fujisawa, both of (JP)

(73) Assignee: Fuji Oozx, Inc., Kanagawa-ken (JP)

( * ) Notice: Subject to any disclaimer, the term of this patent is extended or adjusted under 35 U.S.C. 154(b) by 0 days.

(21) Appl. No.: 09/482,664

(22) Filed: Jan. 13, 2000

Related U.S. Application Data

(62) Division of application No. 08/955,946, filed on Oct. 22, 1997, now abandoned.

(30) Foreign Application Priority Data

Nov. 15, 1996 (JP) ..... 8-304494

(51) Int. Cl.[7] ..... B23P 15/00

(52) U.S. Cl. ..... 29/888.43; 72/47; 72/340

(58) Field of Search ..... 29/888.43; 72/47, 72/340, 703, 476

(56) References Cited

U.S. PATENT DOCUMENTS

| | | | | |
|---|---|---|---|---|
| 4,366,785 | * | 1/1983 | Goloff et al. | 29/888.43 |
| 4,768,476 | * | 9/1988 | Behnke et al. | 29/888.43 |
| 5,185,923 | * | 2/1993 | Taniguchi et al. | 29/888.43 |
| 5,253,418 | * | 10/1993 | Taniguchi et al. | 29/888.43 |
| 5,537,744 | * | 7/1996 | Hirose | 29/888.43 |

* cited by examiner

*Primary Examiner*—I Cuda Rosenbaum

(57) ABSTRACT

A method of manufacturing and Al alloy tappet, used in an internal combustion engine, includes supplying wear resistant particles on a surface of a light metal tappet body, the surface slideably contacting a cam, kneading said particles with a surface layer of the surface of the tappet body to imbed them and then changing the surface layer after kneading to a flat surface.

17 Claims, 3 Drawing Sheets

METHOD OF MANUFACTURING TAPPET IN AN INTERNAL COMBUSTION ENGINE

This application is a divisional application of U.S. patent application Ser. No. 08/955,946 filed Oct. 22, 1997, now abandoned.

BACKGROUND OF THE INVENTION

The present invention relates to a tappet made of light metal such as Al alloy and a method of manufacturing the same.

Recently, tappets used in a direct acting type valve operating mechanism in an internal combustion engine are made of Al alloy to lighten the valve operating mechanism and to increase allowable rotation speed of the engine. Al alloy tappets have lower strength and wear resistance than conventional steel tappets, so that wear resistant materials are mounted or coating layers are formed on the upper surface of the tappets which contact a cam and on the outer circumferential surface which contacts a cylinder head.

FIGS. 8 and 9 show one example of a conventional tappet in which the upper surface which is slidably engaged with a cam is made to provide wear resistance. In FIG. 8, a groove la is formed on the upper surface of an Al alloy tappet body 1, and a wear resistant steel shim 2 is detachably engaged in the groove la. The shim 2 may be fixed by press-fit or casting.

In FIG. 9, a wear resistant cam receiving disc 3 is fixed on the upper surface of the tappet body 1 made of Al alloy by soldering.

In addition to the two examples, particles such as ceramics are dispersed on the whole surface of the tappet body to increase total strength and wear resistance.

In the tappet as shown in FIG. 8, effective surface area of the shim 2 which contacts the cam becomes smaller. Therefore, to obtain a desired lifting amount of. a valve, it is necessary to increase an outer diameter of the tappet body 1 and to mount a larger diameter shim 2. However, such structure increases the whole size of the tappet against lightening, and in addition, a cylinder head in which the tappet is mounted becomes larger to limit flexibility of planning in the engine. High accuracy mechanical processing must be made to the groove la, thereby increasing cost.

In the tappet in FIG. 9, the cam receiving disc 3 is fixed on the whole upper surface of the tappet body 1 to avoid decrease in effective surface area, but owing to connection of different materials, it is troublesome to solder them, thereby increasing cost.

Both the conventional tappets comprise two members, so that it is necessary to provide different size shims 2 and cam receiving discs 3 to make management of parts troublesome and not to attain lightening. Ceramic particles are dispersed on the whole tappet body, but it is difficult to disperse the particles uniformly, so that cost increases.

SUMMARY OF THE INVENTION

In view of the foregoing disadvantages, it is an object of the present invention to provide a tappet in an internal combustion engine and a method of manufacturing the same to increase wear resistance on the cam-contacting surface without attaching a shim or a cam receiving disc, thereby lightening it and saving cost.

According to one aspect of the present invention, there is provided a tappet in an internal combustion engine in which wear resistant particles are dispersed in a surface layer of the surface of the tappet made of light metal, the surface slidably contacting a cam.

Therefore, wear resistance of the surface which slidably contacts the cam can be increased without a shim or cam receiving disc.

According to another aspect of the present invention, there is provided a method of manufacturing a tappet in an internal combustion engine, the method comprising the steps of:

supplying wear resistant particles on the surface of a light metal tappet body, the surface slidably contacting a cam;

kneading said particles with a surface layer of the surface of the tappet body to embed them; and changing the surface layer after kneading to a flat surface.

Therefore, the tappet which has wear resistant surface which contacts the cam can be easily manufactured at low cost.

BRIEF DESCRIPTION OF THE DRAWINGS

The advantages of the invention will become more apparent from the following description with respect to embodiment as shown in accompanying drawings wherein.

DETAILED DESCRIPTION OF PREFERRED EMBODIMENTS

Figure 1:
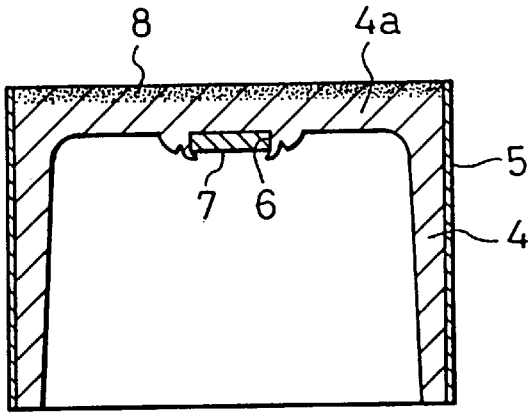
FIG. 1 is a central vertical sectional front view of one embodiment of a tappet according to the present invention.

FIG. 1 illustrates a tappet according to the present invention. A tappet body 4 is made of Al alloy by cold forging to form a cylinder the upper end of which is closed. Spray coating layer is formed on the outer circumferential surface of the tappet body 4.

A wear resistant metal chip 7 which contacts the end of a poppet valve used in an internal combustion engine is put in a groove 6 formed in the middle of the lower surface of a top wall 4*a* of the tappet body 4. Wear resistant hard particles 8 which has a diameter not more than 10 $\mu$m are uniformly embedded. The particles 8 include ceramic powder such as $Al_2O_3$, SiC, NbC, SiN, BN, CrC and $TiB_2$ which have higher melting points than Al alloy, self-lubricating metal powder such as Mo and Si, and intermetallic compounds such as $CrSi_2$ and $MoSi_2$.

The particles 8 dispersed in the surface layer of the top wall 4*a* in the foregoing embodiment make the whole surface which includes sliding surface with a cam rigid to increase strength, thereby increasing wear resistance without mounting a shim or cam receiving plate in conventional methods.

Figure 2:
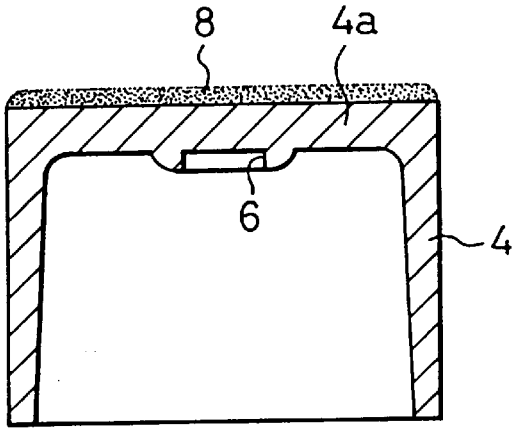
FIG. 2 is a central vertical sectional front view which shows the step for putting particles on the upper surface of a tappet body in a method of manufacturing the tappet according to the present invention.
Figure 3:
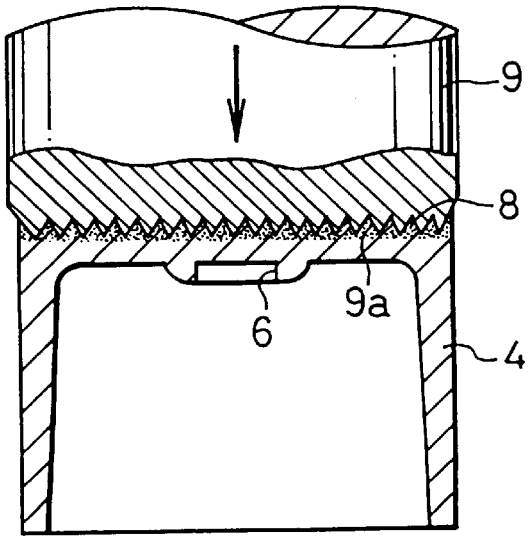
FIG. 3 is a central vertical sectional front view which shows the step for kneading the particles.
Figure 4:
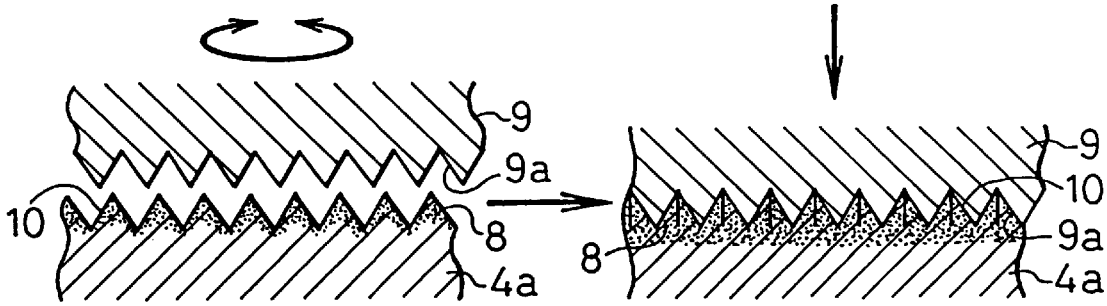
FIG. 4 is a central vertical sectional front view which shows how to knead by moving corrugated edge of a punch horizontally.

FIGS. 2 to 5 illustrate a method of manufacturing the above tappet in order of steps. In FIG. 2, on the upper surface of the top wall 4*a* of the tappet body 4 made of Al alloy by cold forging, the particles 8 are weighed at a desired amount and put at uniform thickness. Then, in FIG. 3, a punch 9 which has a corrugated edge 9*a* on the lower surface is pressed onto the upper surface of the top wall 4*a*, and the edge of the blade cut into the upper surface of the top wall 4*a*, so that the particles 8 are embedded in the surface layer. In FIG. 4, the punch 9 is rotated in normal and reverse directions around an axis little by little, and presses the particles 8 several times while the corrugated edges are horizontally moved. The corrugation 10 is moved at random, so that the particles 8 are kneaded and embedded deeply into the surface layer of the top wall gradually. The upper surface of the punch is not limited to a corrugated form, but other forms may be allowed to knead the particles substantially.

Figure 5:
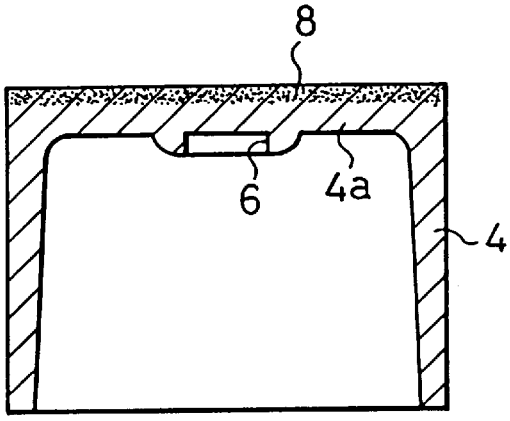
FIG. 5 is a central vertical sectional front view which shows the step in which the surface layer is melted again and solidified to form a flat surface.
Figure 6:
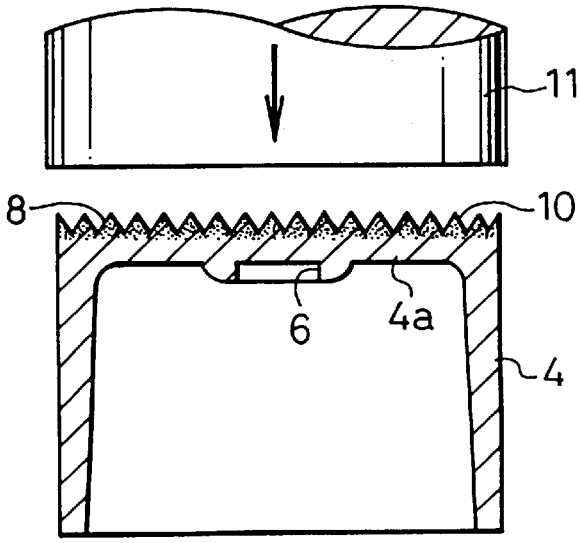
FIG. 6 is a central vertical sectional front view which shows the step in which the surface layer is pressed and rolled by the punch to form a flat surface.

After the kneading step, the surface of the top wall 4*a* is melted again by heating means such as a gas burner, laser beam and plasma arc, and solidified to form a flat surface as shown in FIG. 5. The particles 8 which have higher melting point than that of the tappet body 4 dispersively remain without melting.

Then, the tappet body 4 is subjected to T6 treatment as fixed in JIS (Japanese Industrial Standards). Thereafter, spray coating layer is formed on the outer circumferential surface, and a chip is put in the groove 6 and totally finished to form a tappet as shown in FIG. 1.

Flattening treatment after the kneading step in FIG. 4 may be achieved by pressing and rolling the currugation 10 with the punch 11 which has a flat lower surface. To facilitate rolling, the surface of the top wall 4*a* may be suitably heated and softened.

When the surface of the top wall 4*a* is made to a flat surface by the remelting or the punch 11, pores may be formed on the surface layer, When the pores are fine, oil-keeping capability of lubricating oil is increased to decrease wear in the top wall 4*a* or cam. Thus, the pores may be kept.

Figure 7:
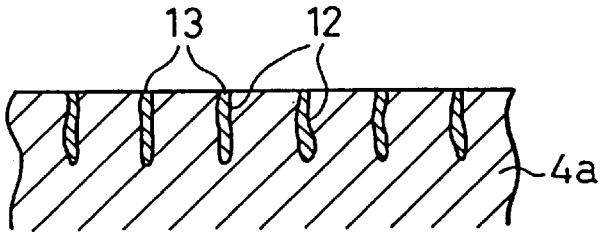
FIG. 7 is an enlarged vertical sectional view which shows that material is filled in pores in the surface layer.
Figure 8:
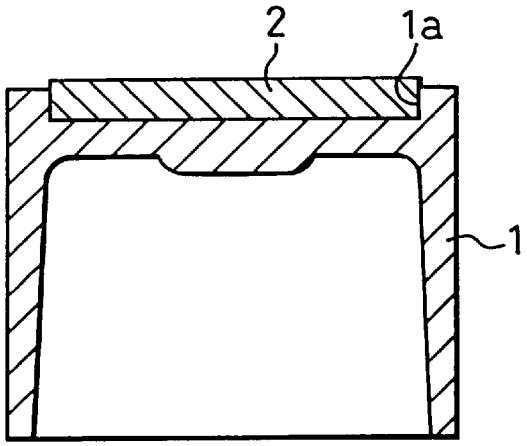
FIG. 8 PRIOR ART
FIG. 8 is a central vertical sectional front view of a conventional tappet.
Figure 9:
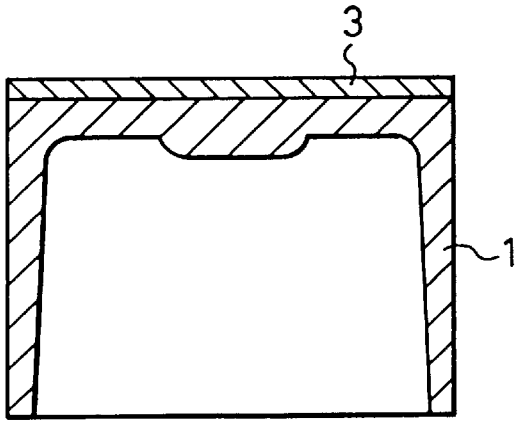
FIG. 9 PRIOR ART
FIG. 9 is a central vertical sectional front view of another conventional tappet.

Relatively large pores increase frictional resistance and decrease density or strength. As shown in FIG. 7, self-lubricating filled material 13 such as $MoS_2$, high molecular weight polyethylene, acetal resin and fluorine resin known as Trademark "Teflon" may be immersed or filled in the pores 12. In the foregoing step, T6 heat treatment and mechanical processing to suitable portions may be carried out before embedding the particles or right after molding the tappet body. The tappet body 4 may be formed by warm or thermal forging, or Al casting other than cold forging.

The foregoings merely relate to embodiments of the invention. Various modifications and changes may be made by person skilled in the art without departing from the scope of claims wherein:

What is claimed is:

1. A method of manufacturing a tappet in an internal combustion engine, the method comprising the steps of:

supplying wear resistant particles on a surface of a light metal tappet body, the surface slidably contacting a cam;

kneading said particles with a surface layer of the surface of the tappet body to embed them; and changing the surface layer after kneading to a flat surface.

2. The method as defined in claim 1 wherein a corrugated edge of a punch is cut into the surface which slidably contacts the cam, the surface being pressed several times with horizontal movement of the corrugated edge to embed the particles in the surface layer.

3. The method as defined in claim 1 wherein the surface layer after kneading is melted again and solidified to form a flat surface.

4. The method as defined in claim 1 wherein the wear resistant particles have higher melting point than that of the tappet body.

5. The method as defined in claim 1 wherein the surface layer after kneading is pressed and rolled to form a flat surface.

6. The method as defined in claim 1 wherein the tappet body before kneading of the particles or after forming the flat surface by kneading is subjected to heat treatment and finishing.

7. The method as defined in claim 1 wherein pores of the surface layer made by forming the flat surface are subjected to filling treatment.

8. The method as defined in claim 1 wherein material for filling treatment comprises self-lubricating material.

9. The method as defined in claim 8 wherein the self-lubricating material is MoS2, polyethylene, acetal resin, or fluorine resin known as Trademark "Teflon".

10. The method as defined in claim 1 wherein the light metal is Al alloy.

11. The method as defined in claim 1 wherein the wear resistant particles have a diameter not more than 10 $\mu$m.

12. The method as defined in claim 1 wherein the wear resistant particles comprise ceramic powder.

13. The method as defined in claim 12 wherein the ceramic powder is $Al_2O_3$, SiC, NbC, SiN, BN, CrC or $TiB_2$.

14. The method as defined in claim 1 wherein the wear resistant particles comprise metal powder.

15. The method as defined in claim 14 wherein the metal powder is Mo or Si.

16. The method as defined in claim 1 wherein the wear resistant particles comprise intermetallic compound.

17. The method as defined in claim 16 wherein the intermetallic compound is $CrSi_2$ or $MoSi_2$.

* * * * *